US010327082B2

(12) United States Patent
Milevski et al.

(10) Patent No.: US 10,327,082 B2
(45) Date of Patent: Jun. 18, 2019

(54) LOCATION BASED TRACKING USING A WIRELESS EARPIECE DEVICE, SYSTEM, AND METHOD

(71) Applicant: BRAGI GmbH, München (DE)

(72) Inventors: Veniamin Milevski, München (DE); Peter Vincent Boesen, München (DE)

( * ) Notice: Subject to any disclaimer, the term of this patent is extended or adjusted under 35 U.S.C. 154(b) by 112 days.

(21) Appl. No.: 15/447,549

(22) Filed: Mar. 2, 2017

(65) Prior Publication Data

US 2017/0257717 A1 Sep. 7, 2017

Related U.S. Application Data

(60) Provisional application No. 62/302,620, filed on Mar. 2, 2016.

(51) Int. Cl.
*H04R 1/10* (2006.01)
*H04R 29/00* (2006.01)

(52) U.S. Cl.
CPC ..... *H04R 29/001* (2013.01); *H04R 1/1016* (2013.01); *H04R 1/1041* (2013.01); *H04R 2420/07* (2013.01); *H04R 2460/07* (2013.01)

(58) Field of Classification Search
CPC .. H04R 29/001; H04R 1/1016; H04R 1/1091; H04R 1/1041; H04R 2460/07; H04R 2420/07
USPC ..... 381/58
See application file for complete search history.

(56) References Cited

U.S. PATENT DOCUMENTS 3,934,100 A 1/1976 Harada
4,150,262 A 4/1979 Ono
4,334,315 A 6/1982 Ono et al.
4,375,016 A 2/1983 Harada
4,588,867 A 5/1986 Konomi
4,654,883 A 3/1987 Iwata
4,682,180 A 7/1987 Gans
4,791,673 A 12/1988 Schreiber
4,865,044 A 9/1989 Wallace et al.
5,191,602 A 3/1993 Regen et al.
5,201,007 A 4/1993 Ward et al.
5,280,524 A 1/1994 Norris
(Continued)

FOREIGN PATENT DOCUMENTS

CN 204244472 U 4/2015
CN 104837094 A 8/2015
(Continued)

OTHER PUBLICATIONS

Akkermans, "Acoustic Ear Recognition for Person Identification", Automatic Identification Advanced Technologies, 2005 pp. 219-223.

(Continued)

*Primary Examiner* — Ahmad F. Matar
*Assistant Examiner* — Sabrina Diaz
(74) *Attorney, Agent, or Firm* — Goodhue, Coleman & Owens, P.C.

(57) ABSTRACT

A system, wireless earpiece, and method for locating a tag utilizing one or more wireless earpieces. The tag is associated with the one or more wireless earpieces. The tag includes identification information. The tag is searched for. The tag is located in response to searching for the tag. Feedback is provided through the one or more wireless earpieces for locating the tag.

20 Claims, 5 Drawing Sheets

(56) References Cited

U.S. PATENT DOCUMENTS

| | | | |
|---|---|---|---|
| 5,295,193 | A | 3/1994 | Ono |
| 5,298,692 | A | 3/1994 | Ikeda et al. |
| 5,343,532 | A | 8/1994 | Shugart |
| 5,363,444 | A | 11/1994 | Norris |
| 5,497,339 | A | 3/1996 | Bernard |
| 5,606,621 | A | 2/1997 | Reiter et al. |
| 5,613,222 | A | 3/1997 | Guenther |
| 5,692,059 | A | 11/1997 | Kruger |
| 5,721,783 | A | 2/1998 | Anderson |
| 5,749,072 | A | 5/1998 | Mazurkiewicz et al. |
| 5,771,438 | A | 6/1998 | Palermo et al. |
| 5,802,167 | A | 9/1998 | Hong |
| 5,929,774 | A | 7/1999 | Charlton |
| 5,933,506 | A | 8/1999 | Aoki et al. |
| 5,949,896 | A | 9/1999 | Nageno et al. |
| 5,987,146 | A | 11/1999 | Pluvinage et al. |
| 6,021,207 | A | 2/2000 | Puthuff et al. |
| 6,054,989 | A | 4/2000 | Robertson et al. |
| 6,081,724 | A | 6/2000 | Wilson |
| 6,094,492 | A | 7/2000 | Boesen |
| 6,111,569 | A | 8/2000 | Brusky et al. |
| 6,112,103 | A | 8/2000 | Puthuff |
| 6,157,727 | A | 12/2000 | Rueda |
| 6,167,039 | A | 12/2000 | Karlsson et al. |
| 6,181,801 | B1 | 1/2001 | Puthuff et al. |
| 6,208,372 | B1 | 3/2001 | Barraclough |
| 6,275,789 | B1 | 8/2001 | Moser et al. |
| 6,339,754 | B1 | 1/2002 | Flanagan et al. |
| 6,408,081 | B1 | 6/2002 | Boesen |
| D464,039 | S | 10/2002 | Boesen |
| 6,470,893 | B1 | 10/2002 | Boesen |
| D468,299 | S | 1/2003 | Boesen |
| D468,300 | S | 1/2003 | Boesen |
| 6,542,721 | B2 | 4/2003 | Boesen |
| 6,560,468 | B1 | 5/2003 | Boesen |
| 6,654,721 | B2 | 11/2003 | Handelman |
| 6,664,713 | B2 | 12/2003 | Boesen |
| 6,694,180 | B1 | 2/2004 | Boesen |
| 6,718,043 | B1 | 4/2004 | Boesen |
| 6,738,485 | B1 | 5/2004 | Boesen |
| 6,748,095 | B1 | 6/2004 | Goss |
| 6,754,358 | B1 | 6/2004 | Boesen et al. |
| 6,784,873 | B1 | 8/2004 | Boesen et al. |
| 6,823,195 | B1 | 11/2004 | Boesen |
| 6,852,084 | B1 | 2/2005 | Boesen |
| 6,879,698 | B2 | 4/2005 | Boesen |
| 6,892,082 | B2 | 5/2005 | Boesen |
| 6,920,229 | B2 | 7/2005 | Boesen |
| 6,952,483 | B2 | 10/2005 | Boesen et al. |
| 6,987,986 | B2 | 1/2006 | Boesen |
| 7,136,282 | B1 | 11/2006 | Rebeske |
| 7,203,331 | B2 | 4/2007 | Boesen |
| 7,209,569 | B2 | 4/2007 | Boesen |
| 7,215,790 | B2 | 5/2007 | Boesen et al. |
| 7,463,902 | B2 | 12/2008 | Boesen |
| 7,508,411 | B2 | 3/2009 | Boesen |
| 7,983,628 | B2 | 7/2011 | Boesen |
| 8,140,357 | B1 | 3/2012 | Boesen |
| 8,994,498 | B2 | 3/2015 | Agrafioti et al. |
| 9,081,944 | B2 | 7/2015 | Camacho et al. |
| 9,510,159 | B1 | 11/2016 | Cuddihy et al. |
| 2001/0005197 | A1 | 6/2001 | Mishra et al. |
| 2001/0027121 | A1 | 10/2001 | Boesen |
| 2001/0056350 | A1 | 12/2001 | Calderone et al. |
| 2002/0002413 | A1 | 1/2002 | Tokue |
| 2002/0007510 | A1 | 1/2002 | Mann |
| 2002/0010590 | A1 | 1/2002 | Lee |
| 2002/0030637 | A1 | 3/2002 | Mann |
| 2002/0046035 | A1 | 4/2002 | Kitahara et al. |
| 2002/0057810 | A1 | 5/2002 | Boesen |
| 2002/0076073 | A1 | 6/2002 | Taenzer et al. |
| 2002/0118852 | A1 | 8/2002 | Boesen |
| 2003/0002705 | A1 | 1/2003 | Boesen |
| 2003/0065504 | A1 | 4/2003 | Kraemer et al. |
| 2003/0100331 | A1 | 5/2003 | Dress et al. |
| 2003/0104806 | A1 | 6/2003 | Ruef et al. |
| 2003/0115068 | A1 | 6/2003 | Boesen |
| 2003/0125096 | A1 | 7/2003 | Boesen |
| 2003/0218064 | A1 | 11/2003 | Conner et al. |
| 2004/0070564 | A1 | 4/2004 | Dawson et al. |
| 2004/0160511 | A1 | 8/2004 | Boesen |
| 2005/0043056 | A1 | 2/2005 | Boesen |
| 2005/0125320 | A1 | 6/2005 | Boesen |
| 2005/0148883 | A1 | 7/2005 | Boesen |
| 2005/0165663 | A1 | 7/2005 | Razumov |
| 2005/0196009 | A1 | 9/2005 | Boesen |
| 2005/0251455 | A1 | 11/2005 | Boesen |
| 2005/0266876 | A1 | 12/2005 | Boesen |
| 2006/0029246 | A1 | 2/2006 | Boesen |
| 2006/0074671 | A1 | 4/2006 | Farmaner et al. |
| 2006/0074808 | A1 | 4/2006 | Boesen |
| 2008/0146890 | A1* | 6/2008 | LeBoeuf ..... A61B 5/0059 600/300 |
| 2008/0254780 | A1 | 10/2008 | Kuhl et al. |
| 2013/0181838 | A1* | 7/2013 | Luke ..... G08B 21/24 340/572.1 |
| 2015/0028996 | A1 | 1/2015 | Agrafioti et al. |
| 2016/0033280 | A1 | 2/2016 | Moore et al. |
| 2016/0164973 | A1* | 6/2016 | Kapoor ..... H04M 1/7253 709/208 |
| 2016/0247378 | A1* | 8/2016 | Baczuk ..... H04W 4/70 |

FOREIGN PATENT DOCUMENTS

| | | | |
|---|---|---|---|
| EP | 1017252 | A2 | 7/2000 |
| GB | 2074817 | | 4/1981 |
| JP | 06292195 | | 10/1998 |
| WO | 2007034371 | A3 | 11/2008 |
| WO | 2012071127 | A1 | 5/2012 |
| WO | 2013134956 | A1 | 9/2013 |
| WO | 2014043179 | A2 | 3/2014 |
| WO | 2015061633 | A2 | 4/2015 |
| WO | 2015110577 | A1 | 7/2015 |
| WO | 2015110587 | A1 | 7/2015 |
| WO | 2016032990 | A1 | 3/2016 |

OTHER PUBLICATIONS

Announcing the $3,333,333 Stretch Goal (Feb. 24, 2014).

BMW, "BMW introduces BMW Connected—The personalized digital assistant", "http://bmwblog.com/2016/01/05/bmw-introduces-bmw-connected-the-personalized-digital-assistant", (Jan. 5, 2016).

BRAGI Is on Facebook (2014).

BRAGI Update—Arrival of Prototype Chassis Parts—More People—Awesomeness (May 13, 2014).

BRAGI Update—Chinese New Year, Design Verification, Charging Case, More People, Timeline(Mar. 6, 2015).

BRAGI Update—First Sleeves From Prototype Tool—Software Development Kit (Jun. 5, 2014).

BRAGI Update—Let's Get Ready to Rumble, A Lot to Be Done Over Christmas (Dec. 22, 2014).

BRAGI Update—Memories From April—Update on Progress (Sep. 16, 2014).

BRAGI Update—Memories from May—Update on Progress—Sweet (Oct. 13, 2014).

BRAGI Update—Memories From One Month Before Kickstarter—Update on Progress (Jul. 10, 2014).

BRAGI Update—Memories From The First Month of Kickstarter—Update on Progress (Aug. 1, 2014).

BRAGI Update—Memories From The Second Month of Kickstarter—Update on Progress (Aug. 22, 2014).

BRAGI Update—New People @BRAGI—Prototypes (Jun. 26, 2014).

BRAGI Update—Office Tour, Tour to China, Tour to CES (Dec. 11, 2014).

BRAGI Update—Status on Wireless, Bits and Pieces, Testing—Oh Yeah, Timeline(Apr. 24, 2015).

BRAGI Update—The App Preview, The Charger, The SDK, BRAGI Funding and Chinese New Year (Feb. 11, 2015).

(56) References Cited

OTHER PUBLICATIONS

BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back to China, Backer Day, on Track(May 16, 2015).
BRAGI Update—Beta2 Production and Factory Line(Aug. 20, 2015).
BRAGI Update—Certifications, Production, Ramping Up.
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2014).
BRAGI Update—On Track, Design Verification, How It Works and What's Next(Jul. 15, 2015).
BRAGI Update—On Track, On Track and Gems Overview.
BRAGI Update—Status on Wireless, Supply, Timeline and Open House@BRAGI(Apr. 1, 2015).
BRAGI Update—Unpacking Video, Reviews on Audio Perform and Boy Are We Getting Close(Sep. 10, 2015).
Hyundai Motor America, "Hyundai Motor Company Introduces a Health + Mobility Concept for Wellness in Mobility", Fountain Valley, Californa (2017).
Last Push Before The Kickstarter Campaign Ends on Monday 4pm CET (Mar. 28, 2014).
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for The Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).

* cited by examiner

LOCATION BASED TRACKING USING A WIRELESS EARPIECE DEVICE, SYSTEM, AND METHOD

PRIORITY STATEMENT

This application claims priority to U.S. Provisional Patent Application 62/302,620, filed on Mar. 2, 2016, and entitled Location Based Tracking Using a Wireless Earpiece Device System and Method, hereby incorporated by reference in its entirety.

BACKGROUND

I. Field of the Disclosure

The illustrative embodiments relate to wireless earpieces. More specifically, but not exclusively, the illustrative embodiments relate to tracking one or more tags or wireless devices utilizing one or more wireless earpieces.

II. Description of the Art

The growth of wireless devices including wearable wireless devices is increasing exponentially. This growth is fostered by the decreasing size of transceivers, chips, and other components as well as enhanced computing and communications standards and protocols. At the same time, tracking the location of specific devices, tools, vehicles, or individuals continues to be a concern. These concerns are legitimate based on the size and scale of environments a typical user may cover in a single day. Securing actions performed by the wearable devices and data and information available through the wearable devices continues to be a concern.

SUMMARY OF THE DISCLOSURE

One embodiment provides a system, method and one or more wireless earpieces for locating a tag utilizing one or more wireless earpieces. The tag is associated with the one or more wireless earpieces. The tag includes identification information. The tag is searched for. The tag is located in response to searching for the tag. Feedback is provided through the one or more wireless earpieces for locating the tag. Another embodiment provides wireless earpieces including a processor and a memory storing a set of instructions. The set of instructions are executed to perform the method described.

Another embodiment provides a wireless earpiece. The wireless earpiece includes a frame for fitting in an ear of a user. The wireless earpiece further includes a logic engine controlling functionality of the wireless earpiece. The wireless earpiece further includes a number of sensors that perform biometric readings of the user and receiving user inputs. The logic engine associates a tag with the wireless earpiece, wherein the tag includes identification information, searches for the tag in response to determining the user is authorized to search for the tag based on the biometric readings or user inputs, locates the tag in response to searching for the tag, and provides feedback through the wireless earpiece for locating the tag.

BRIEF DESCRIPTION OF THE DRAWINGS

Illustrated embodiments are described in detail below with reference to the attached drawing figures, which are incorporated by reference herein, and where.

DETAILED DESCRIPTION OF THE DISCLOSURE

Figure 1:
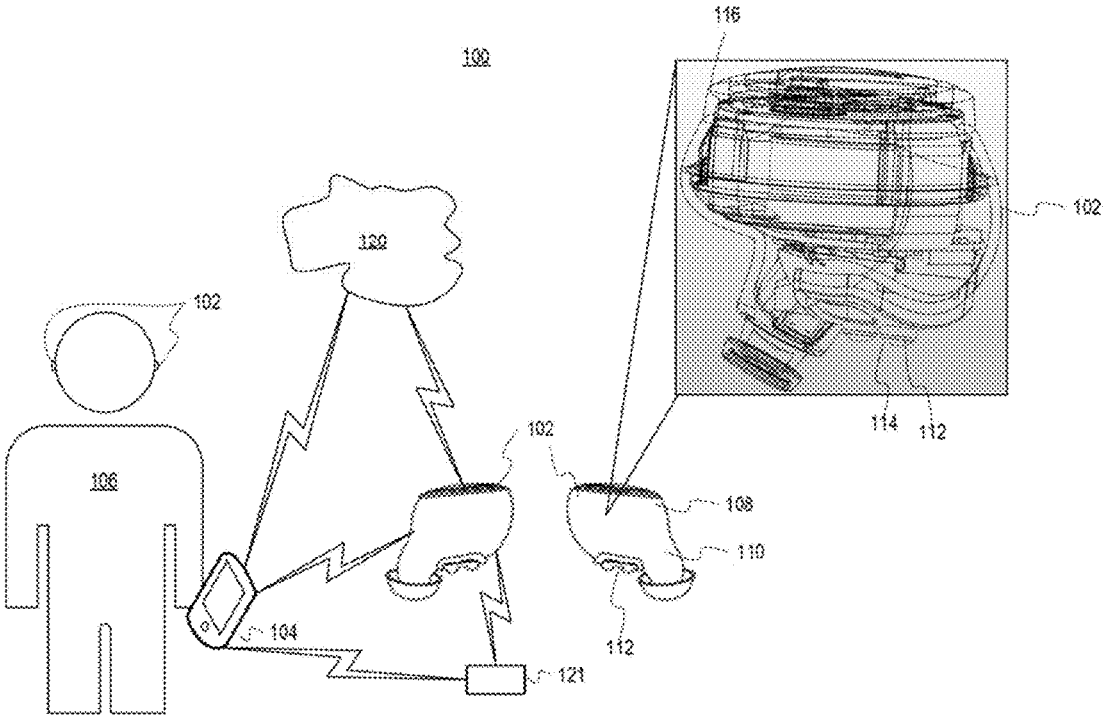
FIG. 1 is a pictorial representation of a communications environment in accordance with an illustrative embodiment.

The illustrative embodiments provide a system, method, and wireless earpieces for performing location based tracking utilizing wireless earpieces. The wireless earpieces are worn in the ear of the user. The wireless earpieces may track one or more wireless tags to facilitate users in remembering, finding, or otherwise locating the tag and a specified device, tool, vehicle, user, or other identified element. The wireless earpieces may work in combination with one or more wireless devices to store applicable data and information, such as identifiers, descriptions, and location. For example, global positioning information, wireless triangulation data, or other location information may be associated with the tag to facilitate locating the tag again regardless of the movements and location of the tag or the user and associated wireless earpieces. In addition, an owner, contact information, device type, identifier, or other information may be associated with the tag and associated person, place, or item tracked by the tag. Authorization to track the tag may be based on one or more passwords, secure identifiers, biometrics, or so forth that may be stored or accessed by the wireless earpieces.

In one embodiment, the wireless earpieces may work in combination with a dynamic or static wireless device, such as a cell phone, smart card, smart wearable (e.g., watch, ring, etc.), radio frequency identification tag, or so forth. The biometric readings of the user may be determined from a pair of wireless earpieces or a single wireless earpiece worn by the user. The description included herein may refer to the wireless earpieces individual or collectively.

The wireless earpieces represent a smart wearable device that may be worn within the ears of the user. As with all personal devices, the wireless earpieces may store valuable personal information including name, address, age, sex, user preferences, user biometrics, user financial information for implementing transactions (e.g., debit/credit card numbers, account numbers, user names, passwords, pins, etc.), location information, and other sensitive personal information. The wireless earpieces include a number of sensors that may be configured to read biometric and environmental information associated with the user. The wireless earpieces may also receive user input from the user including gestures, voice commands, motions, taps, swipes, or other forms of feedback. The biometric information may include heart rate or pattern, fingerprints, mapping of the user's ear/head, voice analysis, skin conductivity, height determinations, and so forth. The biometric readings or information may also be stored for any number of purposes including health monitoring, identification, tracking, and so forth.

The wireless earpieces may be associated or linked with one or more tags that may be attached to devices, items, or users for tracking tags and associated with the identified items. The tags may represent any number of active or passive wireless devices or beacons. Items as defined herein refers to devices, systems, equipment, components, locations, buildings, entries, users/individuals, pets, vehicles, or so forth that a person may want or need to track. In one embodiment, the tags may be associated with the wireless earpieces utilizing proximity (e.g., placed close to each other, touched together, rubbed, etc.), physically connected, connected through a smart charger associated with the wireless earpieces, or so forth. The tags may be coupled to the item utilizing any number of coupling mechanisms, such as Velcro straps, rings, sleeves, adhesives, magnets, grooves, clips, pockets, or so forth.

The movements of the tag and/or wireless earpieces and an associated wireless device may be recorded and accessed for finding the tag utilizing the wireless earpieces or vice versa. Any number of wireless communications standards, protocols, networks, or signals may be utilized for communication between the tags, wireless earpieces, and/or wireless devices. For example, Wi-Fi, Bluetooth, cellular, satellite, near-field magnetic induction (NFMI) communication, or any number of other standards may be utilized.

The location of the tag as well as other relevant information may be indicated utilizing audible indicators (e.g., sounds, spoken commands, text-to-speech (TTS) communications, etc.), tactile feedback, visual commands (e.g., displayed by the wireless earpieces, a connected wireless device, etc.), messages (e.g., text messages, email, in-app communications, etc.), and so forth. For example, the wireless earpieces may guide the user to the tag by providing directions (e.g., straight, forward, left, right, up, down, etc.). The tags and wireless earpieces may utilize global positioning information, systems, and data as well as other location techniques (e.g., signal strength, wireless triangulation, transponder detection, etc.) to track the tags as well as the wireless earpieces and any associated devices.

The wireless earpieces may also provide additional information determined, such as length of time in the current location, movement characteristics (e.g., heading, speed, path, etc.), most recent time of movement, motion relative to other tags or devices, user provided description of the location, and other relevant information. The illustrative embodiments provide additional security because the use of a screen or display is not required. For example, the information may be communicated directly to the user audibly providing enhanced privacy. The user may specify that only authorized or otherwise specified users of the wireless earpieces are allowed to track specified tags. For example, identifying biometric information and/or user input may be required to identify and authenticate the user. The wireless earpieces may also send communications to the tags directly or indirectly (e.g., networks, connection through a wireless device, etc.) from the wireless earpieces.

The illustrative embodiments may allow a user to loan the wireless earpieces to another user without concern for breaching or contamination of their own unique personal biometric data or that of the associated tags. In one embodiment, the primary or administrative user may establish profiles for any number of users that may utilize a single set of wireless earpieces. For example, the primary user may control the user profiles of the secondary users that allows or prevents them from locating specified tags. As a result, any number of users may be able to control and manage access to different data, functions, and so forth available through the wireless earpieces.

The wireless earpieces are configured to fit at least partially into an external auditory canal of the user. The ear canal is a rich space for obtaining biometric measurements about the user as well as stabilizing the wireless earpieces as they are worn. The wireless earpieces may be utilized during a number of rigorous physical activities that require stability. The shape and configuration of the wireless earpieces allow the wireless earpieces to be worn for long periods of time while gathering valuable information utilizing the sensors of the wireless earpieces. The wireless earpieces may include sensors for measuring pule rate, blood oxygenation, microphone, position/orientation, location, temperature, altitude, cadence, calorie expenditure, and so forth.

The wireless earpieces may include any number of sensor arrays configured to capture information about the user. The large amount of data may be utilized to authenticate the user for any number of requests, such as finding a tag. The wireless earpieces may configure themselves to perform various functions as well as sending commands to any number of proximate devices to implement actions, commands, or requests, or transactions. The wireless earpieces may learn over time in response to selections made utilizing the wireless earpieces or interconnected devices, such as a cell phone. The sensors may sense dynamic manifestations including movement patterns, fluidity, hesitations, volume of the voice, amplitude and frequency modulations (e.g., jitter, shimmer rates, etc.) temperature fluctuations, increases or decreases in heart rate, and level of sweat production for comparison utilizing logic of the wireless earpieces to generate one or more actions. Alerts may be played to the user indicating the status of a location request (e.g., initiated, in process, awaiting user verification, approved, rejected, etc.).

FIG. 1 is a pictorial representation of a communication environment 100 in accordance with an illustrative embodiment. The wireless earpieces 102 may be configured to communicate with each other and with one or more wireless devices, such as a wireless device 104. The wireless earpieces 102 may be worn by a user 106 and are shown both as worn and separately from their positioning within the ears of the user 106 for purposes of visualization. A block diagram of the wireless earpieces 102 if further shown in FIG. 2 to further illustrate components and operation of the wireless earpieces 102.

In one embodiment, the wireless earpieces 102 include a frame 108 shaped to fit substantially within the ears of the user 106. The frame 108 is a support structure that at least partially encloses and houses the electronic components of the wireless earpieces 102. The frame 108 may be composed of a single structure or multiple structures that are interconnected. The frame 108 defines an extension 110 configured to fit substantially within the ear of the user 106. The extension 110 may house one or more speakers, ear-bone microphones, or vibration components for interacting with the user. The extension 110 may be removable covered by one or more sleeves. The sleeves may be changed to fit the size and shape of the user's ears. The sleeves may come in various sizes and have extremely tight tolerances to fit the user 106 and one or more other users that may utilize the wireless earpieces 102 during their expected lifecycle. In another embodiment, the sleeves may be custom built to support the interference fit utilized by the wireless earpieces 102 while also being comfortable while worn.

In one embodiment, the frame 108 or the extension 110 (or other portions of the wireless earpieces 102) may include sensors 112 for sensing pulse, blood oxygenation, temperature, voice characteristics, skin conduction, glucose levels, impacts, activity level, position, location, orientation, as well as any number of internal or external user biometrics. A first set of the sensors 112 may represent external sensors that may sense user gestures, contact, motions, fingerprints, and external conditions (e.g., temperature, humidity, pressure, etc.). A number of the sensors 112 may also be internally positioned within the wireless earpieces 102. For example, the sensors 112 may represent metallic contacts, optical interfaces, thermometers, or micro-delivery systems for receiving and delivering information. Small electrical charges may be sensed within the ear of the user 106 as well as passed through the sensors 112 to analyze the biometrics of the user 106 including pulse, skin conductivity, temperature, blood analysis, sweat levels, and so forth. Sensors 112 may also be utilized to provide a small electrical current which may be useful for alerting the user, stimulating blood flow, alleviating nausea, or so forth.

In some applications, temporary adhesives or securing mechanisms (e.g., clamps, straps, lanyards, extenders, chargers, portable battery packs, etc.) may be utilized to ensure that the wireless earpieces 102 remain in the ears of the user 106 even during the most rigorous and physical activities. For example, the wireless earpieces 102 may be utilized during marathons, swimming, team sports, biking, hiking, parachuting, or so forth. The wireless earpieces 102 may be configured to play music or audio, receive and make phone calls or other communications, determine ambient environmental conditions (e.g., temperature, altitude, location, speed, heading, etc.), read user biometrics (e.g., heart rate, motion, temperature, sleep, blood oxygenation, voice output, calories burned, forces experienced, etc.), and receive user input, feedback, or instructions. The wireless device 104 or the wireless earpieces 102 may communicate directly or indirectly with one or more wired or wireless networks, such as a network 120. The wireless earpieces 102 may include logic for dynamically configuring components of the wireless earpieces 102, such as speakers and microphones, to the conditions of the communication environment 100.

The wireless earpieces 102 may determine their position with respect to each other as well as the wireless device 104 and a tag 121. For example, position information for the wireless earpieces 102, the tag 121, and the wireless device 104 may determine proximity of the devices in the communication environment 100. The tag 121 may represent a miniature tracking device. For example, the tag 121 may be a beacon, tracker, smart sticker, radio frequency identification (RFID) device, and any number of currently available or developing devices. For example, the tag 121 may represent devices, such as Tile®, Chipolo, StickNFind, TrackR, Locca, Gecko, Retrievor, Guardian, and so forth. The tag 121 may be actively or passively powered utilizing batteries, fuel cells, induction circuits, solar cells, piezo electric generators, chemical generators, miniature wind turbines, or so forth. For example, global positioning information, wireless triangulation, or signal strength/activity may be utilized to determine proximity and distance of the devices to each other in the communication environment 100 as well as individual location information. The initial location, last known location, or inferred location may be stored with memories of the tag 121, the wireless earpieces 102, and/or the wireless device 104. In one embodiment, the location information may be utilized to provide the user 106 directions to the tag 121. In one embodiment, the directions may be provided audibly to the user (e.g., go straight 200 feet and then left 100 feet, go northeast 30 meters, look behind you 10 feet, etc.). The directions may also be provided through the wireless device 104 utilizing an application or specific interface. Directions may also be provided tactilely (e.g., one vibration—straight, two vibrations—right, three vibrations—left, four vibrations—backwards, etc.). In one embodiment, the distance information may be utilized to determine whether the wireless earpieces 102 are both being worn (e.g., should be experiencing similar environmental conditions, noise, etc.) or whether a single wireless earpiece 102 is being worn.

In one embodiment, the wireless earpieces 102 and the corresponding sensors 112 (whether internal or external) may be configured to take a number of measurements or log information during normal usage. The sensor measurements may be utilized to extrapolate other measurements, factors, or conditions applicable to the user 106. For example, the sensors 112 may monitor the user's heartbeat or EKG to determine the user's unique pattern or characteristics. The user 106 or another party may configure the wireless earpieces 102 and the tag 121 directly or through a connected device and application (e.g., mobile app with a graphical user interface) to store or share location or identification information, audio, images, and other data. The tag 121 may be configured to communicate with any number of preset devices or users. Communications from the tag 121 may include the location of the tag 121 as well as the identifying information associated with the tag. For example, the tag 121 may communicate directions to the tag 121 (e.g., automatically entered, user specified, etc.) and a description of the item associated with the tag 121.

Some examples of standard usage of the wireless earpieces 102 may include detecting and recording a heartbeat, setting a biometric information for identification of a user and locating the tag 121, setting noise thresholds and the associated speaker volume level or microphone sensitivity, setting a user specified gesture/input for performing an action (e.g., playing music, opening an application, providing an audio indication of biometric feedback, etc.), active participation in a conversation, listening to music, or so forth. As a result, the wireless earpieces 102 may be customized to detect and location the tag 121 as well as store and access information associated with the tag 121. A combination, sequence, or concurrent receipt of biometrics and user input may be associated with tags to ensure secure access. Thus, access to various tags as well as the associated features, functions, and data may be secured and protected utilizing unique identifiers. Distinct user profiles and tag access preferences may be utilized to ensure that multiple users may utilize the wireless earpieces 102 with data, functionality, and access for each user and tag being completely secured.

In one embodiment, each of the sensors 112 of the wireless earpieces 102 may perform baseline readings to determine which user is utilizing the wireless earpieces 102 and to adapt to communications environments 100 that may be quiet, slightly noise, loud, or anything in between. For example, the wireless earpieces 102 may determine which of a number of users associated with the wireless earpieces 102 or a guest is utilizing the wireless earpieces 102 and the applicable communications environment 100 (e.g., the user's home, train station, work out areas, office environment, mechanical shop, sports venue, etc.). In one embodiment, the wireless earpieces 102 may determine tags, data, functions, and features that may be accessed based on the user, the user's authorization level, location, activity, and so forth. The components of the wireless earpieces 102, such as the speakers and microphones may then be self-adjusted based on the identified user and information associated with the communications environment 100. For example, location may be determined differently indoors (e.g., wireless triangulation, signal strength measurements, etc.) as compared to outdoors (e.g., global positioning information, proximity data, mesh networks, etc.).

The wireless earpieces 102 may include any number of sensors 112 and logic for measuring and determining user biometrics, such as pulse rate, skin conduction, blood oxygenation, temperature, calories expended, voice and audio output, position, and orientation (e.g., body, head, etc.). The sensors 112 may also determine the user's or tags location, position, velocity, impact levels, and so forth. The sensors 112 may also receive user input and convert the user input into commands or selections made across the personal devices of the personal area network. For example, the user input detected by the wireless earpieces 102 may include voice commands, head motions, finger taps, finger swipes, motions or gestures, or other user inputs sensed by the wireless earpieces 102. The user input may be measured by the wireless earpieces 102 and converted into internal commands (utilized by the wireless earpieces 102 themselves) or external commands that may be sent to one or more external devices, such as the wireless device 104, a tablet computer, or so forth. For example, the user 106 may create a first specific head motion and first voice command that when detected by the wireless earpieces 102 are utilized to automatically record a location of a first tag, a first gesture and a second voice command may authorize the wireless earpieces 102 to communicate the tag's location to the wireless earpieces to be stored for later access. Any number of user biometrics and user input may be utilized alone, or in combination to unlock partitioned data and functionality to effectively sandbox the wireless earpieces 102.

The wireless earpieces may communication with any number of other sensory devices in the communication environment 100 to measure information and data about the tag 121, the user 106, and the communication environment 100 itself. In one embodiment, the communication environment 100 may represent all or a portion of a personal area network. The wireless earpieces 102 may be utilized to control, communicate, manage, or interact with a number of other wearable devices or electronics, such as smart glasses, helmets, smart glass, watches or wrist bands, other wireless earpieces, chest straps, implants, displays, clothing, or so forth. A personal area network is a network for data transmissions among devices, such as personal computing, communications, camera, vehicles, entertainment, and medical devices. The personal area network may utilize any number of wired, wireless, or hybrid configurations and may be stationary or dynamic. For example, the personal area network may utilize wireless network protocols or standards, such as INSTEON, IrDA, Wireless USB, Bluetooth, NFMI, Z-Wave, ZigBee, Wi-Fi, ANT+ or other applicable magnetic or radio frequency signals. In one embodiment, the personal area network may move with the user 106.

In other embodiments, the communication environment 100 may include any number of devices, components, or so forth that may communicate with each other directly or indirectly through a wireless (or wired) connection, signal, or link. The communication environment 100 may include one or more networks and network components and devices represented by the network 120, such as routers, servers, signal extenders, intelligent network devices, computing devices, or so forth. In one embodiment, the network 120 of the communication environment 100 represents a personal area network as previously disclosed. The network 120 may also represent a number of different network types and service providers.

Communications within the communication environment 100 may occur through the network 120 or may occur directly between devices, such as the wireless earpieces 102 and the wireless device 104, or indirectly through a network, such as a Wi-Fi network. The network 120 may communicate with or include a wireless network, such as a Wi-Fi, cellular (e.g., 3G, 4G, 5G, PCS, GSM, etc.), Bluetooth, or other short range or long range radio frequency network. The network 120 may also include or communicate with any number of hard wired networks, such as local area networks, coaxial networks, fiber-optic networks, network adapters, or so forth. Communications within the communication environment 100 may be operated by one or more users, service providers (e.g., secure, public, private, etc.), or network providers.

The wireless earpieces 102 may play, communicate, or utilize any number of alerts or communications to indicate that the status of the access of the searching and location process. For example, one or more alerts may indicate when the tag 121 is within direct communication of the wireless earpieces 102. The alerts may also indicate whether the user is authorized to search for and find the tag 121 based on biometric readings, user input, and so forth (e.g., passwords, identifiers, combinations of passwords, sequential verification, etc.). The alert may also indicate directions to get to the tag 121 from the current location of the user 106, the battery status of the tag 121, and various other available information. The corresponding alerts may also be communicated to the user 106 and the wireless device 104.

In other embodiments, the wireless earpieces 102 may also vibrate, flash, play a tone or other sound, or give other indications of the access process status in order to prompt user actions (e.g., giving a sequence of verbal, motion, or audio search instructions, provide additional feedback, etc.) or implement any number of associated steps. The wireless earpieces 102 may also communicate an alert to the wireless device 104 that shows up as a notification, message, or other indicator indicating the necessity for configuration/re-configuration or a changed status of the configuration process, such as an audio alert that "that tag has changed locations."

The wireless earpieces 102, tag 121, or the wireless device 104 may include logic for automatically implementing access and authorization in response to wireless earpiece set-up, start-up, condition changes (e.g., location, activities, etc.), event happenings, user requests or various other conditions and factors of the communication environment 100. For example, the wireless device 104 may communicate instructions received from the wireless earpieces 102 for the user 106 to locate the tag 121 or to unlock the data, functions, and features. The wireless device 104 may include an application that displays instructions and information to the user 106 for searching for and locating the tag.

In one embodiment, the wireless device 104 may utilize short-range or long-range wireless communications to communicate with the wireless earpieces 102 or tag 121 through a wireless signal or devices of the communication environment 100. For example, the wireless device 104 may include a Bluetooth and cellular transceiver within the embedded logical components. For example, the wireless signal may be a Bluetooth, Wi-Fi, Zigbee, Ant+, near-field magnetic induction (NFMI), or other short range wireless communication.

The wireless device 104 may represent any number of wireless or wired electronic communications or computing devices, such as smart phones, laptops, desktop computers, control systems, tablets, displays, gaming devices, music players, personal digital assistants, vehicle systems, or so forth. The wireless device 104 may communicate utilizing any number of wireless connections, standards, or protocols (e.g., near field communications, NFMI, Bluetooth, Wi-Fi, wireless Ethernet, etc.). For example, the wireless device 104 may be a touch screen cellular phone that communicates with the wireless earpieces 102 utilizing Bluetooth communications. The wireless device 104 may implement and utilize any number of operating systems, kernels, instructions, or applications that may make use of the available sensor data sent from the wireless earpieces 102. For example, the wireless device 104 may represent any number of Android, iOS, Windows, open platforms, or other systems and devices. Similarly, the wireless device 104 or the wireless earpieces 102 may execute any number of applications that utilize the user input, proximity data, biometric data, and other feedback from the wireless earpieces 102 to initiate, authorize, or perform access associated tasks.

As noted, the layout of the internal components of the wireless earpieces 102 and the limited space available for a product of limited size may affect where the sensors 112 and other components may be positioned. The positions of the sensors 112 within each of the wireless earpieces 102 may vary based on the model, version, and iteration of the wireless earpiece design and manufacturing process.

Figure 2:
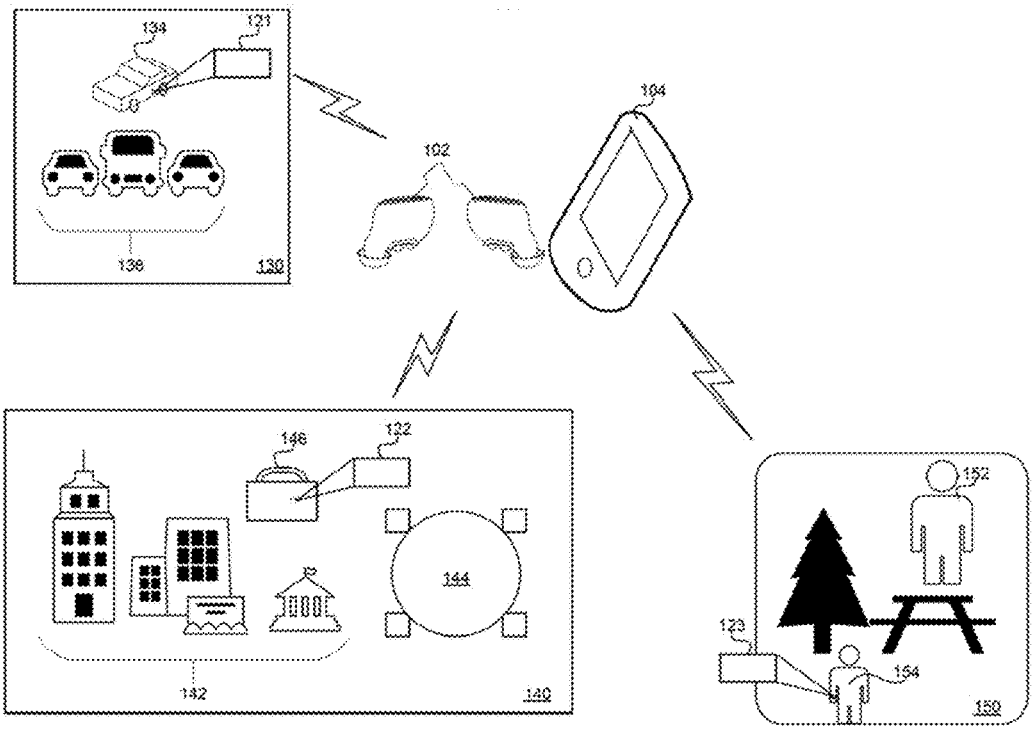
FIG. 2 is a pictorial representation of other communications environments in accordance with an illustrative embodiment.

FIG. 2 illustrates a pictorial representation of other communications environments 130, 140, 150 in accordance with illustrative embodiments. The communications environments 130, 140, 150 may represent any number of environments, conditions, locations, structures, or places that a user may visit, travel to, work at, or dwell. In one example, the communications environments 130, 140, 150 may represent different places visited by a user utilizing the wireless earpieces 102 and tags 120, 121, 123.

In one embodiment, the communications environment 130 may represent a parking lot or parking garage where the user may park her car 134. The car 134 may be permanently or temporarily marked with the tag 124 facilitating the user in finding the car 134. As previously noted, the car 134 as set forth is provided as one example of an item that may be tracked by the tag 121. The communications environment 130 may include a number of cars 136 including the car 134 of the user. As a result, it may be difficult to locate the car 134 based on changes in lighting, movement of vehicles, passage of time (e.g., forgetfulness, exhaustion, etc.). Communications between the tag 121 and the wireless earpieces 102 and/or wireless device 104 may facilitate the user in finding the car 134. The wireless earpieces 102 may also store user specified instructions for finding the car 130 in the communications environment 130, such as "remember the North East corner of level 3." This information may be played back to the user through the wireless earpieces 102 in response to the user nearing or entering the communications environment 130, the user asking about the location of the car 134, or in response to communications signals, links, or pings being established or received by the wireless earpieces 102.

In one embodiment, the tag 121 may store the make, model, VIN number, license plate number, and contact information (e.g. address, phone number, email address, etc.) and other applicable information associated with the user or car 134. The tag information may also be utilized in the event the car 134 is stolen, lost, recovered, or in the event of an emergency. In one embodiment, once the car 134 is stopped or parked at the communications environment 130, the wireless earpieces 102 as well as the wireless device 104 may record the time and location of the car 134. The user may also provide user input or feedback that is associated with the tag 121, such as parking space number, parking lot number, section, latitude and longitude, or other global positioning information. The additional information recorded or associated with the tag 121 may facilitate locating the car 134 at a later time. As shown, the tag 121 may communicate directly with the wireless earpieces 102 and/or the wireless device 104. For example, any number of Wi-Fi, Bluetooth, cellular, or satellite signals, links, networks, or connections may be utilized. In addition, developing communications standards may also be utilized.

In one embodiment, the wireless earpieces 102 may independently guide the user back to the tag 121 and associated car 134. For example, audio clues, commands, or feedback may be communicated directly to the ears of the user. As a result, privacy is maintained, outside parties are unaware of the direction the user is traveling, and the location of the car 134 is safeguarded. For example, the wireless earpieces 102 may provide verbal commands, such as straight ahead, turn left, turn right, and turnaround to help the user find the car 134. The wireless earpieces 102 may also store a path used when originally leaving the car 134 that may be utilized as a (re-trace route) option available to the user.

In another embodiment, the tag 121 may be tracked by the wireless device 104. The wireless earpieces 102 may be utilized to provide guidance for the user to return to the location of the vehicle 134/tag 121. In the examples provided, either the wireless earpieces 102 and/or the wireless device 104 may include an application, logic, operating system, or set of instructions that track the location of the tag 121 based on the last known position, signal sent by the tag 121 in real-time, or based on a direct connection to the tag 121. As a result, the instructions, feedback, and input for returning to the tag 121 may be provided through the wireless earpieces 102.

The communications environment 140 provides another place that the user may visit. As shown, the communications environment 140 may include any number of buildings 142 as well as a stadium 144 that may be utilized to host sporting events, concerts, meetings, and other activities. As shown, the user may have access to any number of tags that may be utilized for different items and in different situations. In one embodiment, the user may have taken a briefcase 146 that includes the tag 122. The user may have been in and out of any number of buildings for work, entertainment, or regular daily activities. In one embodiment, the user may have inadvertently left the briefcase 146 behind with the associated tag 122. The tag 122 as well as the wireless earpieces 102 and the wireless device 104 may store a location each time the briefcase is set down or stops moving. In one embodiment, the tag 122 may include one or more accelerometers or inertial sensors that detect the motion or lack thereof with regard to the briefcase 146. For example, messages may be communicated between the tag 122 and the wireless earpieces 102 and/or wireless device 104 regarding last known position of the briefcase 146 and the tag 122.

The wireless earpieces 102 may guide the user back to the briefcase 146. Tactile commands, such as vibrations or electrical impulses may also be utilized to guide the user. For example, vibrations generated in both years by the wireless earpieces 102 may indicate to go forward, while vibration pulses in the left wireless earpiece or the right wireless earpiece alone may indicate to go left or right, respectively. Double vibration pulses communicated by the wireless earpieces 102 may indicate for the user to turn around.

The communications environment 150 provides another example of a place that users may visit. In one embodiment, a parent 152 may utilize the tag 123 to track a child 154. The wireless earpieces 102 may be utilized in conjunction with the wireless device 104 to detect and track the location of the child 154. In one embodiment, the communications environment 150 may represent a park, forest, amusement park, school, or other indoor or outdoor location. As shown, the tag 123 may be a wristband, anklet, necklace, label, clip-on, or so forth. The tag 123 may be integrated into any number of pieces of clothing, jewelry, accessories, or so forth to effectively track the child 154.

As previously described, the wireless earpieces 102 may provide the parent 152 with direct communications regarding the location of the child 154 as well as other information, such as heading, speed, initial location, last detected location, and activity if known. For example, the parent 152 may get a status update in response to asking a question such as "where is my child?" The wireless earpieces 102 may communicate with the tag 123 to receive applicable information, such as "your child is 30 feet northwest of your location." The wireless earpieces 102 may also provide feedback to arrive at the position of the child 154, such as "walk 40 feet forward and 20 feet to the left to find Susie."

The wireless earpieces 102 may also work with the wireless device 104 to provide feedback to the parent 152. The wireless device 104 (or the wireless earpieces 102) may include an internal mapping system, application, database, or so forth that may provide additional details regarding the communications environment 150. For example, an applicable map of the communications environment 150 may indicate obstacles, such as trees, shrubbery, buildings, tables, structures, playground equipment, bathrooms, and so forth. The mapping application may also be utilized to provide audible feedback for the parent 152 wearing one or more of the wireless earpieces 102 to find the child 154 with the tag 123.

As previously noted, the tags 121, 122, 123 may communicate with a number of wireless devices, cellular network components, network equipment, or other devices as part of a mesh network. As a result, the wireless earpieces 102 may indirectly receive information with regard to the position and location of the tags 121, 122, 123. Similarly, the wireless earpieces 102 and wireless device 104 may relay messages as nodes in a mesh network related to tags (not shown) that are not associated with the wireless earpieces 102.

Figure 3:
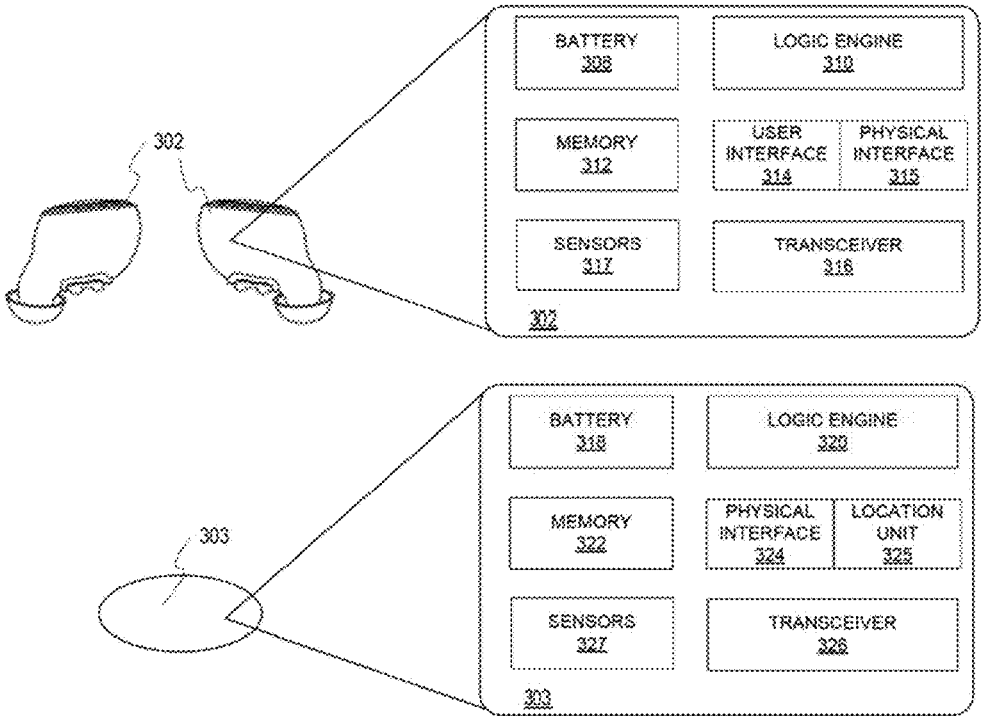
FIG. 3 is a block diagram of wireless earpieces and a tag in accordance with an illustrative embodiment.

FIG. 3 further illustrates a block diagram of the wireless earpieces 302 and the tag 303. As noted, the components of the wireless earpieces 302 may be described collectively rather than individually. The wireless earpieces 302 may be wirelessly linked to any number of wireless devices, such as the wireless device 104 of FIG. 1. For example, wireless devices may include wearable devices, communications devices, computers, entertainment devices, vehicle systems, exercise equipment, or so forth. Sensor measurements, user input, and commands may be received from either the wireless earpieces 302, the tag 303, or the wireless device (not shown) for processing and implementation on any of the devices (or other externally connected devices). Reference to the wireless earpieces 302 may descriptively or functionally refer to either the pair of wireless earpieces (wireless earpieces) together or individual wireless earpieces (left wireless earpiece and right wireless earpiece) without limitation. Description of components of the wireless earpieces 302 also named with regard to the tag 303 are similarly applicable.

In some embodiments, the wireless device may also act as a logging tool for sensor data or measurements made by the wireless earpieces 302. For example, the wireless device may receive and share data captured by the wireless earpieces 302 in real-time including biometric or location information, such as authentication biometrics or input, status of the user (e.g., physical, emotional, etc.), last known location of the tag 303, and so forth. As a result, the wireless device may be utilized to store, display, and synchronize sensor data received from the wireless earpieces 302. For example, the wireless device may display user pulse rate, temperature, proximity, location, blood oxygenation, distance, calories burned, and so forth as measured by the wireless earpieces 302. The user or a request may also be authenticated by sending the data to the wireless device that may then authenticate the data and authorize a request, function, feature, or so forth. The wireless device may be configured to receive and display alerts that indicate conditions to initiate, process, and authenticate a search or locate request have been met. For example, if a request is made and the wireless earpieces 302 may automatically display as an alert, message, or in-app communication, such as "please authenticate you have permission to find this tag." The wireless earpieces 302 and the wireless device may have any number of electrical configurations, shapes, and colors and may include various circuitry, connections, and other components utilized to perform the illustrative embodiments.

In one embodiment, the wireless earpieces 302 may include a battery 308, a logic engine 310, a memory 312, a user interface 314, a physical interface 315, a transceiver 316, and sensors 317. Similarly, the tag may have a battery 318, a logic engine 310, a memory 322, a physical interface 324, a location unit 325, sensor 327, and a transceiver 326. The wireless device may have any number of configurations and include components and features as are known in the art.

The battery 308 is a power storage device configured to power the wireless earpieces 302. In other embodiments, the battery 308 may represent a fuel cell, thermal electric generator, piezo electric charger, solar charger, ultra-capacitor, or other existing or developing power storage technology. The sensors 317 may also be utilized to measure the temperature of the battery 308 and the conditions and status of internal components of the wireless earpieces. The sensors 317 may also be utilized to determine data about internal and external conditions and factors applicable to the user, the user's environment, a communicating wireless device, or so forth. Other conditions and factors sensed by the sensors 317 (e.g., water/humidity, pressure, blood oxygenation, blood content levels, altitude, position, impact, radiation, etc.) may also be determined with the data being processed by the logic engine 310.

The logic engine 310 is the logic that controls the operation and functionality of the wireless earpieces 302. The logic engine 310 may include circuitry, chips, and other digital logic. The logic engine 310 may also include programs, scripts, and instructions that may be implemented to operate the logic engine 310. The logic engine 310 may represent hardware, software, firmware, or any combination thereof. In one embodiment, the logic engine 310 may include one or more processors. The logic engine 310 may also represent an application specific integrated circuit (ASIC) or field programmable gate array (FPGA). The logic engine 310 may utilize sensor measurements, user input, user preferences and settings, conditions, factors, and environmental conditions to determine the identity of the user, at least in part, from measurements performed by the wireless earpieces 302. This information may also be utilized to authenticate the user. The wireless earpieces 302 may function separately or together to authenticate tag searching, tracking or locating is being performed by an authorized user. For example, processing may be divided between the wireless earpieces 302 to increase the speed of processing and to load balance any processes being performed. For example, a left wireless earpiece may perform imaging of the user's ear to identify the user while the right wireless earpiece may identify voice characteristics of the wireless earpieces. Multiple forms of identifying information may be utilized to better secure requests authenticated through the wireless earpieces.

In one embodiment, the logic engine 310 may perform the authentication determination based on measurements and data from the sensors 317. The logic engine 310 may also perform any number of mathematical functions (e.g. linear extrapolation, polynomial extrapolation, conic extrapolation, French curve extrapolation, polynomial interpretation) to determine or infer the identity of the user from the sensor measurements as well as determine whether a biometric identifier or password is verifiably received. The logic engine 310 may utilize time and other sensor measurements as causal forces to enhance a mathematical function utilized to perform the determinations, processing, and extrapolation performed by the logic engine 310.

The logic engine 310 may also process user input to determine access commands implemented by the wireless earpieces 302 or sent to the wireless earpieces 302 through the transceiver 316. Specific actions may be allowed based on sensor measurements, extrapolated measurements, environmental conditions, proximity thresholds, and so forth. For example, the logic engine 310 may implement an authentication macro allowing the user to automatically unlock a tracking application utilizing a heartbeat pattern and voice command. In another embodiment, different types of actions may require different levels or combinations of biometric and user information. For example, low value data, such as tag identifier data, may require a single piece of identifying information (e.g., ear mapping) whereas high value data, such as current location of the tag (if known) may require three pieces of identifying information (e.g., skin conductivity, user specified gesture, user sign on to the wireless earpieces 302).

The logic engine 310 is configured to perform all or a substantial portion of the processing needed for the illustrative embodiments. In one embodiment, the logic engine 310 may associate the tag 303 with the wireless earpieces 302. For example, the logic engine 310 may associate an identifier (e.g., serial number, custom name, etc.) of the wireless earpieces 302 with the tag 303 my storing the identifier in the memory 312. The logic engine 310 may also track and record the initial or last known location of the tag 303. The tag 303 may be tracked directly if within range of the wireless earpieces 302 or indirectly (e.g. cellular signals, satellite signals, network signals, other users/mesh network nodes, etc.). The logic engine 310 may also facilitate the user in searching for, locating, and navigating to the tag 303. In one embodiment, the logic engine 310 may execute a mapping application that facilitates the user in driving, walking, writing, or otherwise navigating to the location of the tag 303. For example, the logic engine 310 may provide instructions or commands for the user interface 314 including a speaker, vibrator, or other interface components to navigate to the tag 303. Instructions provided to the user through the speaker of the user interface 314 may be particularly secure because outside parties are not able to easily intercept or listen in to the audio feedback.

In another embodiment, the logic 310 may send a message to the tag 303 from the transceiver 316 to the transceiver 326 to play a sound, light up, vibrate, or otherwise communicate with the user that may be searching for the tag 303. The physical interface 324 of the tag 303 may include user interface and physical interface components as described with respect to the wireless earpieces 302.

In one embodiment, a processor included in the logic engine 310 is circuitry or logic enabled to control execution of a set of instructions. The processor may be one or more microprocessors, digital signal processors, application-specific integrated circuits (ASIC), central processing units, or other devices suitable for controlling an electronic device including one or more hardware and software elements, executing software, instructions, programs, and applications, converting and processing signals and information, and performing other related tasks.

The memory 312 is a hardware element, device, or recording media configured to store data or instructions for subsequent retrieval or access at a later time. The memory 312 may represent static or dynamic memory. The memory 312 may include a hard disk, random access memory, cache, removable media drive, mass storage, or configuration suitable as storage for data, instructions, and information. In one embodiment, the memory 312 and the logic engine 310 may be integrated. The memory may use any type of volatile or non-volatile storage techniques and mediums. The memory 312 may store information related to the user, wireless earpieces 302, tag 303, wireless device 304, and other peripherals, such as a wireless device, smart glasses, smart watch, smart case for the wireless earpieces 302, wearable device, and so forth. In one embodiment, the memory 312 may store, display, or communicate instructions, programs, drivers, or an operating system for controlling the user interface 314 including one or more LEDs or other light emitting components, speakers, tactile generators (e.g., vibrator), and so forth. The memory 312 may also store biometric readings, user input required for specified data, functions, or features, authentication settings and preferences, thresholds, conditions, signal or processing activity, historical information, proximity data, and so forth. The memory 312 may also store instructions, applications, or so forth for tracking and locating the tag 202.

The transceiver 316 is a component comprising both a transmitter and receiver which may be combined and share common circuitry on a single housing. The transceiver 316 may communicate utilizing NFMI, Bluetooth, Wi-Fi, ZigBee, Ant+, near field communications, wireless USB, infrared, mobile body area networks, ultra-wideband communications, cellular (e.g., 3G, 4G, 5G, PCS, GSM, etc.), infrared, or other suitable radio frequency standards, networks, protocols, or communications. For example, the transceiver 316 may coordinate communications and actions between the wireless earpieces 302 utilizing NFMI communications. The transceiver 316 may also be a hybrid transceiver that supports a number of different communications. For example, the transceiver 316 may communicate with the tag 303, wireless devices, or other systems utilizing wired interfaces (e.g., wires, traces, etc.), NFC, or Bluetooth communications. The transceiver 316 may also detect amplitudes and infer distance between the wireless earpieces 302 and external devices, such as the wireless device or a smart case of the wireless earpieces 302.

In one embodiment, the transceiver 316 may be configured to determine a location of the tag 303 utilizing signal strength, wireless triangulation, or directional feedback. For example, the transceiver 316 may include one or more antennas that facilitate detecting the amplitude, communicated direction of signals received, and so forth. In one embodiment, the wireless earpieces 302 may work as separate receivers to determine a distance, orientation, or location of the tag 303. For example, when worn, the wireless earpieces 302 may be separated by a known distance associated with the user's head. The distance between the wireless earpieces 302 as well as the time stamp associated with when a signal was received may be utilized to determine a direction and/or location to the tag 303. Similarly, any number of tables, distances, thresholds, database entries, or historical information may be utilized to determine a distance and direction between the wireless earpieces 302 and the tag 303 in a particular environment.

The components of the wireless earpieces 302 may be electrically connected utilizing any number of wires, contact points, leads, busses, wireless interfaces, or so forth. In addition, the wireless earpieces 302 may include any number of computing and communications components, devices or elements which may include busses, motherboards, circuits, chips, sensors, ports, interfaces, cards, converters, adapters, connections, transceivers, displays, antennas, and other similar components. The physical interface 315 is hardware interface of the wireless earpieces 302 for connecting and communicating with wireless devices, tags, or other electrical components, devices, or systems.

The physical interface 315 may include any number of pins, arms, or connectors for electrically interfacing with the contacts or other interface components of external devices or other charging or synchronization devices. For example, the physical interface 315 may be a micro USB port. In one embodiment, the physical interface 315 is a magnetic interface that automatically couples to contacts or an interface of a wireless device or tag. In another embodiment, the physical interface 315 may include a wireless inductor for charging the wireless earpieces 302 without a physical connection to a charging device.

The user interface 314 is a hardware interface for receiving commands, instructions, or input through the touch (haptics) of the user, voice commands, or predefined motions. For example, the user interface 314 may include a touch screen, one or more cameras or image sensors, microphones, speakers, and so forth. The user interface 314 may be utilized to control the other functions of the wireless earpieces 302. The user interface 314 may include the LED array, one or more touch sensitive buttons or portions, a miniature screen or display, or other input/output components. The user interface 314 may be controlled by the user or based on commands received from the wireless device. For example, the user may turn on, reactivate, implement searches, or provide feedback utilizing the user interface 314.

In one embodiment, the user interface 314 may include a fingerprint scanner that may be utilized to scan a fingerprint (e.g., the index finger) of a user to authenticate a user, request, functionality, or so forth. The user interface 314 of each of the wireless earpieces 302 may store identifying information for one or more fingers. In one embodiment, the biometric data of the user may be encrypted and stored within a secure portion of the memory 312 to prevent unwanted access or hacking. The wireless earpieces 302 may also store important biometric data, such as medical information (e.g., medical conditions, allergies, logged biometrics, contacts, etc.) that may be shared in response to an emergency.

In one embodiment, the user may provide user feedback for authenticating a search request by tapping the user interface 314 once, twice, three times, or any number of times (e.g., sequentially or in a timed pattern). Similarly, a swiping motion may be utilized across or in front of the user interface 314 (e.g., the exterior surface of the wireless earpieces 302) to implement a predefined action. Swiping motions in any number of directions or gestures may be associated with specific requests as well as other activities, such as locate a tag, share exercise data, share a music playlist, enable a dictation feature, open a specified app, share user vitals, play music, pause, fast forward, rewind, activate a digital assistant (e.g., Siri, Cortana, smart assistant, etc.), or so forth without limitation. The swiping motions and gestures may also be utilized to control actions and functionality of tags, wireless devices, or other external devices (e.g., smart television, camera array, smart watch, etc.) through wireless signals sent by the transceiver 316. The user may also provide user input for authorizing an action or request by moving his head in a particular direction or motion or based on the user's position or location. For example, the user may utilize voice commands, head gestures, or touch commands to change the content displayed by a wireless device as received from the wireless earpieces 302. For example, a user may provide a verbal command to "provide walking directions to the tag on my bicycle." The speaker of the user interface 314 may then provide audible instructions and indicators which may include direction, heading, suggested speed, obstacles in the path, suggestions, or so forth. The user interface 314 may also provide a software interface including any number of icons, soft buttons, windows, links, graphical display elements, and so forth for receiving user input.

In one embodiment, the user interface 314 may periodically utilize one or more microphones and speakers of the wireless earpieces to authenticate the user. The microphone of the user interface 314 may measure various voice characteristics including amplitude, shimmer rates (i.e., changes in amplitude over time) frequency/pitch, jitter rates (i.e., changes in frequency data over time), accent, voice speed, inflection, and so forth. Specific words, phrases, or sounds may be associated with actions as stored in the memory 312 and detected by one or more microphones of the user interface 314. The microphones may include external microphones positioned on the outside surface(s) of the wireless earpieces 302 (e.g., air microphones) as well as internal microphones (e.g., bone, ear-bone microphones, etc.). The wireless earpieces 302 may also recognize a pre-defined vocabulary. For example, specific words may be required to authenticate different requests and action types.

The sensors 317 may include inertial sensors, pulse oximeters, accelerometers, gyroscopes, magnetometers, water, moisture, or humidity detectors, impact/force detectors, thermometers, photo detectors, miniature cameras, microphones, and other similar instruments for identifying the user and reading biometrics as well as location, utilization of the wireless earpieces 302, orientation, motion, and so forth. The sensors 317 may also be utilized to determine the biometric, activity, location, and speed measurements of the user. In one embodiment, the sensors 317 may store data that may be shared with other components (e.g., logic engine 310 authenticating a search request), users, and devices.

The sensors 317 may include photodetectors, ultrasonic mapping devices, or radar that scan the ear of the user when positioned for utilization. The sensors 317 may generate a two or three dimensional scan or topography map of the user's ear and surrounding areas when the wireless earpieces 302 are properly positioned. The mapping may include the internal and/or external portions of the user's ear. The topographical image of the user's ear may be utilized as a stand-alone biometric identifier or may be utilized with other biometric identifiers to identify the user. The image may include the external auditory meatus, scapha, fossa triangularis, scaphoid fossa, helix, antihelix, antitragus, lobule, the tragus, and pinna as well as other internal or external portions of the ear and surrounding head structure.

Externally connected wireless devices as well as the tag 303 may include components similar in structure and functionality to those shown for the wireless earpieces 302. For example, a wireless device may include any number of processors, batteries, memories, busses, motherboards, chips, transceivers, peripherals, sensors, displays, cards, ports, adapters, interconnects, sensors, and so forth. In one embodiment, the wireless device may include one or more processors and memories for storing instructions. The instructions may be executed as part of an operating system, application, browser, or so forth to implement the features herein described. For example, the user may set preferences for the wireless earpieces 302 to work individually or jointly to identify user biometrics for comparison against known values to verify the user is authorized to search for, locate, or track a tag. Likewise, the preferences may manage the actions taken by the wireless earpieces 302 in response to identifying specific users are utilizing the wireless earpieces 302. For example, a parent user may have full access to track any number of tags, but a juvenile user may only have access to track a tag associated with a family vehicle. In one embodiment, the wireless earpieces 302 may be magnetically or physically coupled to the wireless device to be recharged or synchronized.

The wireless device may also execute an application with settings or conditions for updating, synchronizing, sharing, saving, processing requests and utilizing biometric information. For example, one of the sensors 317 that may have failed may be ignored in response to improper or unreliable data being gathered. As a result, the user identification process for performing authorizations may be dynamically performed utilizing any combination of sensor measurements. For example, the number and position of the sensors 317 utilized to perform status determinations for the user may vary based on failures, inaccurate data, or other temporary or permanent issues with hardware and software of the wireless earpieces 302.

In one embodiment, the tag 303 may include all or a portion of the components shown in FIG. 3. As previously noted, the tag 303 may be an actively or passively power device. In one embodiment, the tag 303 includes a battery 318 to communicate with other devices, such as the wireless earpieces 302, utilizing the transceiver 326. In another embodiment, the tag 303 may be passively powered utilizing induction based on radio frequency waves, wireless signals, or so forth. For example, the tag 303 may be powered on in response to receiving a particular signal or at a specified distance.

The logic engine 320 may also represent a processor or fixed digital logic that provides identification, location (e.g., direction, position, orientation, etc.), and other information and data applicable to the tag 303 or the wireless earpieces 302. For example, the logic engine 320 may represent a chip configured to implement specified processes, sets, and instructions in response to signals from the wireless earpieces 302 or in response to other conditions, settings, or preferences.

The memory 322 may store identification and location information. For example, specified biometric information, user input, or other secure identifiers may be required to be received by the transceiver 326 of the tag 303 and verified by the logic engine 320 against data, values, or information stored by the memory 322 in order to be associated with other devices, communicate, provide location information, or so forth.

The physical interface 324 may allow the tag 303 to be physically, magnetically, or electrically coupled with any number of other devices, such as the wireless earpieces 302, a smart case of the wireless earpieces 302, a cell phone link to the wireless earpieces 302, or other electronic devices. In another embodiment, the physical interface 324 may also include user interface components similar to those described for the wireless earpieces 302. For example, the physical interface 324 may include one or more touchscreens or texts sensitive components, light emitting diodes, speakers, microphones, or so forth.

The location unit 325 (or the transceiver 326) may include one or more location detection devices, such as a global positioning system, wireless triangulation unit, signal strength and direction detector, or so forth. In one embodiment, the location unit 325 may determine a location of the tag 302. The location may be determined utilizing latitude and longitude, location relevant to a mapping database, or location and/or distances relative to the wireless earpieces 302 or an associated wireless device. The location unit 325 may be configured to determine the exact location, known landmark(s) (e.g., roads, parks, homes, businesses, etc.), or an identified user (e.g., the user/device may represent a known node in a mesh network). The location unit 325 may be controlled by the logic engine 322 to send location and identification information to other electronic devices, such as the wireless earpieces 302, utilizing the transceiver 326. The location unit 325 may also communicate instructions, feedback, or commands through the transceiver 326 that may be received by the transceiver 316, and converted by the logic engine 310 into verbal or audible instructions, feedback, or commands for the user to find the tag 303.

As noted, the tag 303 may also include the sensors 327. The sensors 327 may detect the orientation, environment, internal characteristics, or other conditions and factors that may affect the tag 303 as previously described with regard to the sensors 317 of the wireless earpieces 302.

The transceiver 326 may include one or more of a transmitter and/or receiver. In one embodiment, the tag 303 may include a transmitter only, in another embodiment, the tag 303 may include a receiver only, or the tag 303 may include a transceiver as shown in FIG. 3. The transceiver 326 may be configured to communicate directly or indirectly with one or more wireless earpieces 302, wireless devices, other tags, satellite devices, wireless network equipment, systems, or devices. As previously noted, any number of communications standards, protocols, or signals may be utilized.

Figure 4:
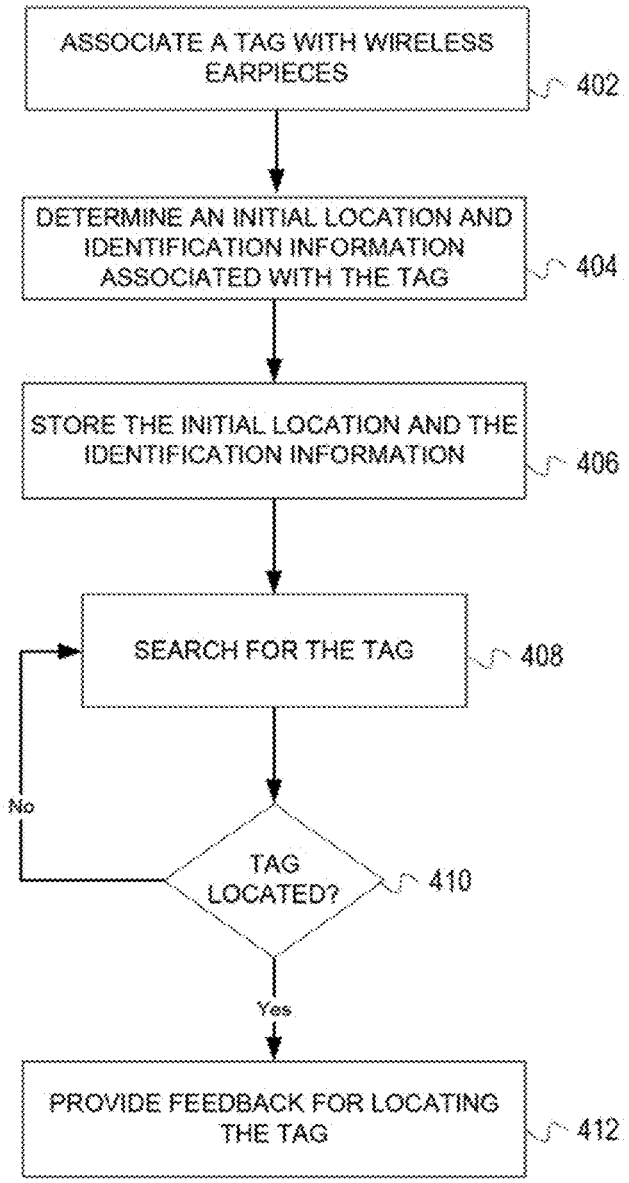
FIG. 4 is a flowchart of a process for tracking a tag in accordance with an illustrative embodiment.

FIG. 4 is a flowchart of a process for tracking a tag in accordance with an illustrative embodiment. In one embodiment, the process of FIG. 4 may be implemented by one or more wireless earpieces, such as the wireless earpieces 102 of FIG. 1. For example, the method of FIG. 4 may be performed for both of the wireless earpieces as a pair/set or for each of wireless earpieces individually to track one or more tags. As previously noted, the tags represent any number of tracking devices, systems, identifiers, or so forth. In one embodiment to perform any tracking for the tags, the wireless earpieces may require biometric readings or user input to authenticate or identify the user and that the user is authorized to track the associated tag(s). In one embodiment, the biometric readings and user input may include one or more of pulse, hand gestures, designated motions, voice amplitude, voice frequency, skin conductivity, vocabulary, blood oxygenation, temperature, heart beat pattern, ear map, calories expended per time period, sweat levels, orientation, position, and so forth.

The method of FIG. 4 may be performed to track or locate a tag. The process of FIG. 4 may be performed by one or more of the wireless earpieces and one or more wireless devices (e.g., cell phone, tablet, gaming device, smart card, etc.). In one embodiment, one or more applications or other software interfaces of both the wireless device and the wireless earpieces may interact to perform the communications of FIG. 4, with only the wireless earpieces referred to for purposes of simplicity. For example, the wireless earpieces may take advantage of the larger battery, increased processing power, mapping applications, global positioning system, wireless network, larger antenna, and enhanced transceiver available through the wireless device to perform the methods, processes, and steps described herein.

The process may begin by associating a tag with wireless earpieces (step 402). Although referred to singularly as a tag, the tag may represent any number of trackers. The tag may be associated with the wireless earpieces utilizing any number of processes or steps. For example, the wireless earpieces may be placed in close proximity to the tag or vice versa, the tag may be physically (e.g. connected via a wire to one or more of the wireless earpieces, a wireless device, a computing system, or a smart case associated with the wireless earpieces, etc.) or wirelessly interfaced with the wireless earpieces (e.g. Bluetooth linking, password or pin verification, etc.).

Next, the wireless earpieces determine an initial location and identification information associated with the tag (step 404). The initial location may be a last known location where the tag was last detected, tracked, or observed by the wireless earpieces or and associated wireless device, a location where the tag was last detected at rest, location associated with a particular activity (e.g. the gym, church, a particular class at college or high school, a play date, etc.). The wireless earpieces or the tag may also determine the location utilizing global positioning information, wireless triangulation, past activities, or other location or positioning information determined directly or indirectly by any of the wireless earpieces, tags, or wireless devices associated with the wireless earpieces. The identification information may provide details and identifying information regarding the item tracked by the tag (e.g. make, model, owner, contact information, name of a person, age, school, address, etc.). The identifying information may be openly available to all or may be encrypted, password protected, or otherwise secured to ensure that only authorized users or public support organizations, such as police, firefighters, or social workers are able to access the information. In one embodiment, the identification information may include a unique identifier associated with the tag. The unique identifier may be stored in one or more public and/or private databases to retrieve the identification information. In some instances, the initial location and identification may not be known and as a result steps 402-406 may be optional.

Next, the wireless earpieces store the initial location and the identification information (step 406). In one embodiment, the initial location and the identification information may be stored in a memory of the wireless earpieces. The location and identification information may also be stored in a wireless device, computing device, cloud network, or other applicable system, equipment, or device. In another embodiment, steps 402-406 may be a discrete process that may be performed before utilizing the tag with the wireless earpieces.

Next, the wireless earpieces search for the tag (step 408). The wireless earpieces may search for the tag automatically or in response to user input. In one embodiment, the tag may send out a ping or beacon signal at a preset interval (e.g., based on the power level of the tag) that may be detected by the wireless earpieces or the associated wireless device. The wireless earpieces or the wireless device may also send out a similar signal for detection by the tag. Discrete communications, a wireless link or connection, or other wireless signals may be utilized between the tag and the wireless earpieces/wireless device. In one embodiment, the wireless earpieces may search for the tag in response to determining that specific criteria or conditions are met. For example, the criteria or conditions may include time of day, location, activity, or so forth. The wireless earpieces may automatically search for the tag in response to determining that the user is proximate the initial/last known location of the tag. In another embodiment, the wireless earpieces may search for the tag in response to a user command, request, question, or so forth. For example, in response to a question, such as "Where is Pete?", the wireless earpieces may begin searching for the tag.

Next, the wireless earpieces determine whether the tag is located (step 410). In one embodiment, the tag is located in response to detecting a signal from the tag. Other embodiments may require that the wireless earpieces and the tag be wirelessly linked or within a specified distance threshold to be considered located. For example, the wireless earpieces may require an exact location (e.g., latitude and longitude, relative to a mapping application, relative to the user, etc.).

If the tag is not located during step 410, the wireless earpieces continued to search for the tag (step 408). The wireless earpieces may search for the tag utilizing one or more searching algorithms conditioned based on location of the user, last known location of the tag, known or estimated battery life of the wireless earpieces, tag, or associated wireless device, communications ranges, or other conditions, factors, or user input. In one embodiment, the wireless earpieces may ping (or cause a ping to be sent) to the tag in order to determine whether the tag is within range or a known location.

If the tag is located during step 410, the wireless earpieces provide feedback for locating the tag (step 412). The feedback may be input, instructions, commands, or other communications that guide the user to the location of the tag. The feedback may guide the user to the tag over a short time or a long-term period.

In one embodiment, to perform the processes of step 402 or 4084 associating a tag with the wireless earpieces or searching for the tag, the wireless earpieces may be required to identify the user utilizing the wireless earpieces as well as determine that the user is authorized to perform the denoted steps of the FIG. 4. The wireless earpieces may be configured to automatically or manually (e.g., response to a user selection or input) perform the identification and authentication of the user. For example, the wireless earpieces may automatically identify the user utilizing the wireless earpieces in response to the wireless earpieces being powered on, removed from the case, inserted into an ear of the user, changing locations, detecting a voice change, detecting a change in the connected wireless device, determining biometric identifiers are distinct, or so forth.

In one embodiment, authenticate the user or a search request for the tag may be required before searching for the tag (step 408). The wireless earpieces may require biometric readings, user input, or a combination of biometric readings and user input to authenticate the user and/or track a tag. In one embodiment, the identification process may be performed automatically in response to a request to locate a tag. The sensor locations and types of sensors within the wireless earpieces may vary. The sensors may generate a number of biometric readings that may be utilized individually or compiled to subsequently identify the user and specific biometric factors. The sensors may include one or more inertial sensors, temperature sensors, heart pulse rate sensors, skin conductivity sensors, and microphones (i.e., analyzing the user's voice). The sensors may measure data or information that may be utilized to determine or imply the user's identity as herein described.

The sensor may utilize any number of sampling rates or time periods for performing the sensor measurements. For example, the sensors may identify the user from the moment the wireless earpieces or placed in the ears of the user such that any potential tag location requests may be automatically authenticated as belonging to the authorized user. The biometric readings may also be performed in response to receiving a user request to find a tag. In another embodiment, the biometric readings may represent user input purposely provided by the user as part of the location process, such as gestures, motions, verbal commands, posing, sounds, and so forth. The specified user input or baseline readings for the biometric readings may have been previously entered, saved, or logged for utilization as part of the location process. For example, the wireless earpieces may store user preferences and access information that specify the type, order, and accuracy of biometric information and user input required to perform authentication.

The wireless earpieces may also analyze the biometric readings to determine whether the wireless earpieces are authorized to search for the tag. The biometric readings or other user input may be analyzed for accuracy statistical significance, and so forth. For example, the biometric readings may be compared against default, baseline, or standard biometric readings for the user to ensure accuracy in identifying the user or required identifier. Likewise, user input that may be received for verification purposes may be compared against pre-established or trained data. The wireless earpieces may also perform biasing or error correction as needed to ensure the sensor measurements are accurate. For example, if a sensor from one of the wireless earpieces is experience incorrect or inaccurate data, the data from that sensor may be disregarded for purposes of performing analysis. The sensor measurements may be run through any number of computations utilizing the processor of one of the wireless earpieces. In one embodiment, a number of biometric readings and/or user input may be required to be received sequentially, simultaneously, or concurrently.

In one embodiment, before searching for the tag, the wireless earpieces may first determine whether performing search and location actions to locate the tag are allowed. If the location process is not allowed, the process may end. For example, searching may be authorized in response to an identity associated with the user. The identity of the user may be determined utilizing the biometric readings. In one embodiment, a number of different users may utilize the wireless earpieces at any given time. For example, each of the different users may have distinct tags, personal information, security settings, permissions, applications and preferences that may be located or utilized by the user. The wireless earpieces may ensure that all security measures, conditions, thresholds, and information are provided and authenticated to perform the searching and locating process. In the given example, if authorization is granted, the wireless earpieces may search for the tag (step 408). In another embodiment, the wireless device may search for the tag with information and coordination performed through the wireless earpieces. During steps 408 and 410 the wireless earpieces may fulfill the request directly or indirectly.

During the steps of FIG. 4 any number of alerts may be generated indicating the status of the association, location determination, and so forth. For example, the alerts may be communicated to the user as an audio, tactile, or visual alert, such as "The tag has been located?" The alert may also be communicated to a wireless device in communication with the wireless earpiece. For example, an alert may be sent to a cell phone in communication with the wireless earpiece to display an application specific alert to the user, such as "the tag is located at the Westin hotel two blocks North and one block West." In some embodiments, the alert may be sent through email, text message, or other designated communications technique in the event that the wireless earpieces are being utilized by an unauthorized party. The process of FIG. 4 may allow the wireless earpieces to utilize logic to associate, locate, store, search for, and find one or more tags.

The illustrative embodiments provide a system, method, and wireless earpiece(s) for locating one or more tags associated with the wireless earpieces or a wireless device. The illustrative embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computing system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Computer program code for carrying out operations of the embodiments may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN), a personal area network (PAN), or a wide area network (WAN), or the connection may be made to an external computer (e.g., through the Internet using an Internet Service Provider).

Figure 5:
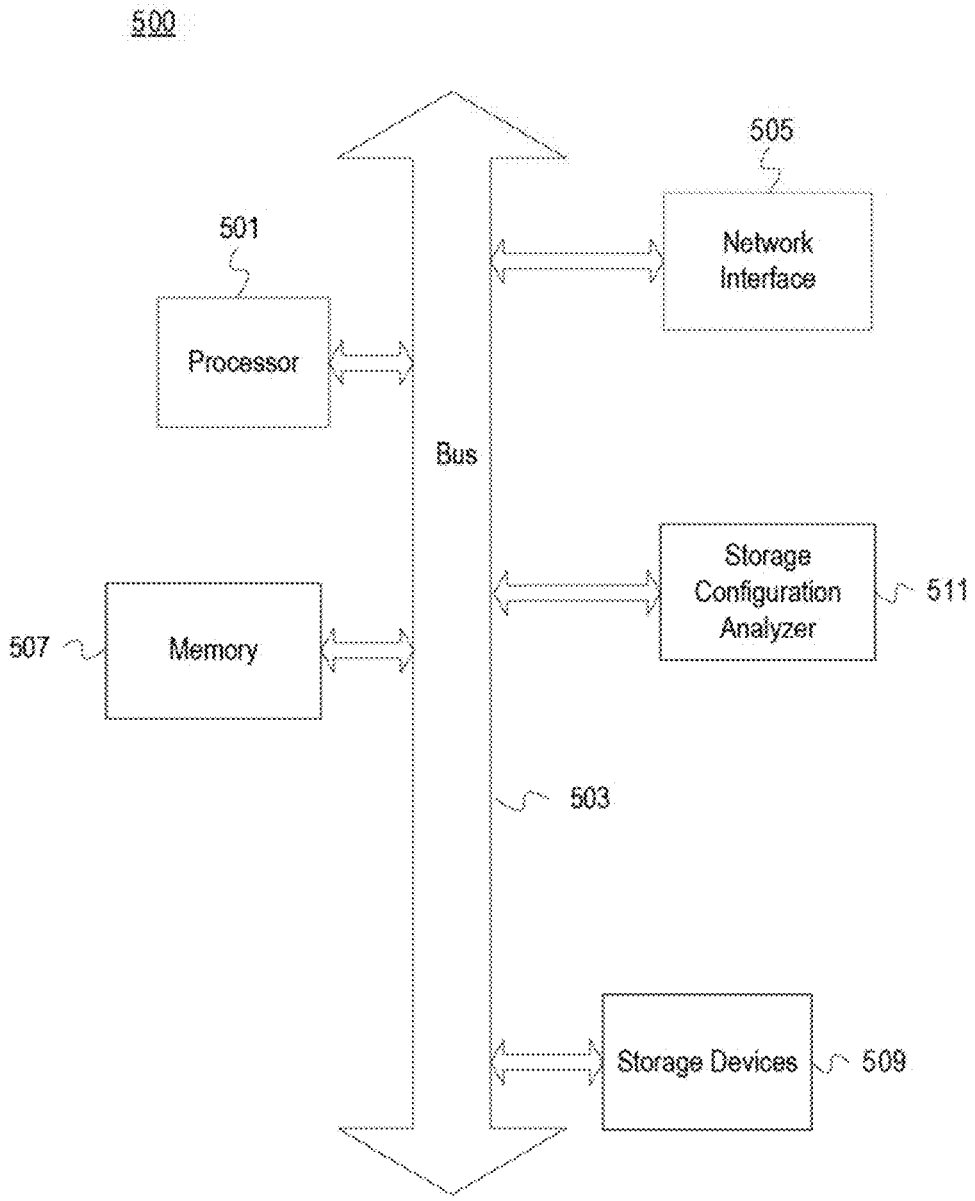
FIG. 5 depicts a computing system in accordance with an illustrative embodiment.

FIG. 5 depicts a computing system 500 in accordance with an illustrative embodiment. For example, the computing system 500 may represent a device, such as the wireless device 104 of FIG. 1. The computing device 500 may be utilized to record locations, search for the tags, locate the tags, provide guidance, map the tags, or perform any number of operations on behalf of associated wireless earpieces. The computing system 500 includes a processor unit 501 (possibly including multiple processors, multiple cores, multiple nodes, and/or implementing multi-threading, etc.). The computing system includes memory 507. The memory 507 may be system memory (e.g., one or more of cache, SRAM, DRAM, zero capacitor RAM. Twin Transistor RAM, eDRAM, EDO RAM, DDR RAM, EEPROM, NRAM, RRAM, SONOS. PRAM, etc.) or any one or more of the above already described possible realizations of machine-readable media. The computing system also includes a bus 503 (e.g., PCI, ISA, PCI-Express, HyperTransport®, InfiniBand®, NuBus, etc.), a network interface 505 (e.g., an ATM interface, an Ethernet interface, a Frame Relay interface, SONET interface, wireless interface, etc.), and a storage device(s) 509 (e.g., optical storage, magnetic storage, etc.). The system memory 507 embodies functionality to implement embodiments described above. The system memory 507 may include one or more functionalities that facilitate retrieval of the audio information associated with an identifier. Code may be implemented in any of the other devices of the computing system 500. Any one of these functionalities may be partially (or entirely) implemented in hardware and/or on the processing unit 501. For example, the functionality may be implemented with an application specific integrated circuit, in logic implemented in the processing unit 501, in a co-processor on a peripheral device or card, etc. Further, realizations may include fewer or additional components not illustrated in FIG. 5 (e.g., video cards, audio cards, additional network interfaces, peripheral devices, etc.). The processor unit 501, the storage device(s) 509, and the network interface 505 are coupled to the bus 503. Although illustrated as being coupled to the bus 503, the memory 507 may be coupled to the processor unit 501.

The illustrative embodiments are not to be limited to the particular embodiments described herein. In particular, the illustrative embodiments contemplate numerous variations in the type of ways in which embodiments may be applied. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. A method for locating a tag utilizing one or more wireless earpieces, the method comprising:

linking the tag with the one or more wireless earpieces when the tag is in proximity with the one or more wireless earpieces, wherein the tag includes identification information and wherein the tag is configured to wirelessly communicate with the one or more wireless earpieces;

determining whether a user of the one or more wireless earpieces is authorized to search for the tag;

searching for the tag, wherein the searching is performed using the one or more wireless earpieces;

locating the tag in response to searching for the tag with the wireless earpiece to provide a location of the tag; and generating audio feedback through the one or more wireless earpieces to the user wearing the one or more wireless earpieces for locating the tag.

2. The method of claim 1, further comprising:

performing biometric readings for the user utilizing sensors of the one or more wireless earpieces;

determining whether the user is authorized to search for the tag, wherein the searching is performed in response to determining the user is authorized to search for the tag.

3. The method of claim 1, further comprising:

determining an initial location associated with the tag if known; and storing the initial location.

4. The method of claim 2, further comprising:

rejecting a request to perform the searching in response to determining the biometric readings do not authorize the one or more wireless earpieces to fulfill the request.

5. The method of claim 4, wherein the biometric readings include voice characteristics, pulse, ear mapping, and temperature.

6. The method of claim 1, wherein the one or more wireless earpieces are a pair of wireless earpieces.

7. The method of claim 4, wherein the request is associated with information securely stored by the one or more wireless earpieces.

8. The method of claim 2, wherein the biometric readings are automatically read by the one or more wireless earpieces in response to the one or more wireless earpieces being worn by the user.

9. The method of claim 1, wherein the searching is performed automatically in response to the one or more wireless earpieces being proximate the tag.

10. The method of claim 1, wherein the audio feedback provides audible instructions directly to the user wearing the one or more wireless earpieces for locating the tag.

11. The method of claim 1, wherein the feedback is audibly communicated as speech.

12. A wireless earpiece comprising:

a processor for executing an application; and a memory for storing the application, wherein the application is executed to:

link a tag with the wireless earpiece when the tag is in proximity with the wireless earpiece, wherein the tag includes identification information, and wherein the tag is in wireless communication with the wireless earpiece;

determine whether a user of the wireless earpiece is authorized to search for the tag;

if the user is authorized to search for the tag, search for the tag using the wireless earpiece;

locate the tag in response to searching for the tag using the wireless earpiece; and provide audio feedback through the wireless earpiece to the user of the wireless earpiece for locating the tag.

13. The wireless earpiece of claim 12, wherein the wireless earpiece sends a command for a wireless device associated with the wireless earpiece to search for the tag.

14. The wireless earpiece of claim 12, wherein the application is further executed to:

authenticate that the user utilizing the wireless earpiece is authorized to locate the tag.

15. The wireless earpiece of claim 14, wherein the user is authenticated utilizing one or more biometric readings or user inputs received from the user.

16. The wireless earpiece of claim 12, wherein the wireless earpiece is one of a pair of wireless earpieces worn in ears of the user.

17. The wireless earpiece of claim 12, wherein the wireless earpiece searches for the tag in response to 1) nearing an initial location stored by the wireless earpiece, 2) receiving a ping from the tag, or 3) receiving user input to search for the tag.

18. The wireless earpiece of claim 12, wherein an initial location of the tag is determined utilizing global positioning information, wireless triangulation, or wireless signal strength and wherein the application is further executed to: play alerts to the user regarding a status of locating the tag.

19. A wireless earpiece for location-based tracking, comprising:

a frame;

a transceiver operatively located within the frame for transmitting and receiving communications;

a processor operatively located within the frame and operatively coupled to the transceiver and executing an application; and a memory operatively located within the frame and operatively coupled to the processor and storing the application, wherein the application is executed to:

link a tag with the wireless earpiece when the tag is in proximity with the wireless earpiece, wherein the tag includes identification information, and wherein the tag is in wireless communication with the wireless earpiece;

search for the tag using the wireless earpiece;

locate the tag in response to searching for the tag using the wireless earpiece; and send a message through the transceiver to the tag directing the tag to play a sound, light up vibrate or otherwise communicate with a user searching for the tag.

20. The wireless earpiece of claim 19, wherein the application can determine whether the user of the wireless earpiece is authorized to search for the tag.

* * * * *